US011421863B2

(12) United States Patent
Wang et al.

(10) Patent No.: US 11,421,863 B2
(45) Date of Patent: Aug. 23, 2022

(54) QUICK-INSTALL STRUCTURE FOR ELECTRICAL DEVICE

(71) Applicant: Jiawei Renewable Energy Co., Ltd., Shenzhen (CN)

(72) Inventors: Chunbao Wang, Shenzhen (CN); Jinlong Ma, Shenzhen (CN); Jinping Sui, Shenzhen (CN); Liang Bai, Shenzhen (CN); Qi Liu, Shenzhen (CN); Tuo Xu, Shenzhen (CN)

(73) Assignee: Jiawei Renewable Energy Co., Ltd., Shenzhen (CN)

( * ) Notice: Subject to any disclaimer, the term of this patent is extended or adjusted under 35 U.S.C. 154(b) by 397 days.

(21) Appl. No.: 16/478,412

(22) PCT Filed: Mar. 11, 2019

(86) PCT No.: PCT/CN2019/077710
§ 371 (c)(1),
(2) Date: Jul. 16, 2019

(87) PCT Pub. No.: WO2020/015370
PCT Pub. Date: Jan. 23, 2020

(65) Prior Publication Data

US 2021/0404637 A1 Dec. 30, 2021

(30) Foreign Application Priority Data

Jul. 17, 2018 (CN) ..... 201810781676.7

(51) Int. Cl.
*F21V 21/02* (2006.01)
*F21V 21/14* (2006.01)
(Continued)

(52) U.S. Cl.
CPC ..... *F21V 21/02* (2013.01); *F21S 2/005* (2013.01); *F21V 21/14* (2013.01); *F21V 23/06* (2013.01)

(58) Field of Classification Search
CPC .... F21S 8/03; F21S 8/033; F21S 8/048; F21S 2/005; H01R 4/52; H01R 4/48; H01R 13/426; F16M 13/02; F16M 13/027
See application file for complete search history.

(56) References Cited

U.S. PATENT DOCUMENTS

2009/0135598 A1* 5/2009 Amos ..... F21V 15/005 362/249.01

FOREIGN PATENT DOCUMENTS

CN 2869575 Y 2/2007
CN 203703684 U 7/2014
(Continued)

OTHER PUBLICATIONS

International Search Report dated Jun. 17, 2019 issued in corresponding International Application No. PCT/CN2019/077710. 11 Pages.

*Primary Examiner* — Anabel Ton
(74) *Attorney, Agent, or Firm* — Polsinelli PC

(57) ABSTRACT

The present disclosure relates to a quick-install structure for an electrical device, including a base and a module. The base is provided with at least two gripping slots. The module is detachably installed on the base. The module is provided with at least two gripping hooks, and the gripping hooks are in one-to-one correspondence with the gripping slots. When the gripping hooks are inserted in the gripping slots, the module has a first position and a second position relative to the base. When in the first position, the gripping books grip with the gripping slots tightly. When in the second position, the gripping hooks are detached from the tight gripping with
(Continued)

the gripping slots. The module is switchable between the first position and the second position.

19 Claims, 5 Drawing Sheets

(51) Int. Cl.
*F21S 2/00* (2016.01)
*F21V 23/06* (2006.01)

(56) References Cited

FOREIGN PATENT DOCUMENTS

| | | | | | |
|---|---|---|---|---|---|
| CN | 205640576 | U | | 10/2016 | |
| CN | 107786935 | A | * | 3/2018 | ..... H04R 1/025 |
| CN | 207394558 | U | | 5/2018 | |
| CN | 108662474 | A | | 10/2018 | |
| JP | H0916530 | | | 6/1997 | |

* cited by examiner

QUICK-INSTALL STRUCTURE FOR ELECTRICAL DEVICE

CROSS REFERENCE TO RELATED APPLICATIONS

The present application is a national Phase filing under 35 U.S.C. § 371 of PCT/CN2019/077710 filed on 11 Mar. 2019 which claims priority of China Patent Application No. CN201810781676.7, filed with the CNIPA on Jul. 17, 2018, entitled "QUICK-INSTALL STRUCTURE FOR ELECTRICAL DEVICE", the entire contents of which are expressly incorporated by reference herein in their entireties.

TECHNICAL FIELD

The present disclosure relates to the technical field of electrical devices, and more particularly to a quick-install structure for an electrical device of luminaires.

BACKGROUND

Luminaires commonly existing in the market implement fastening of installation of the entirety by screws, and in turn implement power-on by connecting to a power lead. Such a structure brings inconvenience to detachment for maintenance, or replacement. Therefore, on the market appear some structures capable of being quickly installed. These quick-install structures are powered by inserting two metal posts into a base, while the fastening of installation may be implemented by the two metal posts. Such a quick-install structure is capable of implementing the power-on and fastening of the installation, without any additional auxiliary fastening structure, such that reliability of the fastening of installation is not high sufficiently, and is needed to be improved.

SUMMARY

According to various embodiments of the present disclosure, it is needed to provide a quick-install structure for an electrical device.

The quick-install structure for an electrical device includes:

a base provided with at least two gripping slots; and a module detachably installed on the base, the module being provided with at least two gripping hooks, and the gripping hooks are in one-to-one correspondence with the gripping slots; wherein when the gripping hooks are inserted in the gripping slots, the module has a first position and a second position relative to the base, and when in the first position, the gripping hooks grip with the gripping slots tightly; when in the second position, the gripping hooks are detached from the tight gripping with the gripping slots; the module is switchable between the first position and the second position.

Details of one or more embodiments of the disclosure are described in the accompanying drawings and description below. Other features, objectives, and advantages of the disclosure will become apparent from the description, drawings and claims.

BRIEF DESCRIPTION OF THE DRAWINGS

In order to better describe and illustrate the embodiments and/or examples of the disclosure disclosed herein, one or more drawings may be referred. Additional details or examples for describing the drawings should not be considered as limiting the scope of the disclosure, the presently described embodiments and/or examples, and the best mode of the disclosure currently understood.

FIG. 4-1 is a perspective diagram illustrating the assembled base and module of the quick-install structure for an electrical device when a tab is in a retraction state, omitting a rear cap.

FIG. 4-2 is a perspective diagram illustrating the assembled base and the module of the quick-install structure for an electrical device when the tab is in a protrusion state, omitting the rear cap.

DETAILED DESCRIPTION OF THE EMBODIMENTS

To facilitate understanding the present disclosure, it will be described hereinafter more thoroughly in reference with the relating accompanying drawings. The preferred embodiments of the present disclosure are provided in the accompanying drawings. However, the present disclosure may be implemented in various forms, and not limited in the embodiments described herein. In contrast, the objective of providing these embodiments is to understand the disclosed description of the present disclosure more thoroughly.

It should be noted that when an element is referred to as being "provided on" another element, it can be provided directly on the other element or an interposing element can be present. When an element is deemed to be "connected" to another element, it can be connected directly to the other element or an interposing element can be present at the same time.

Unless defined otherwise, all technical and scientific terms as used herein have the same meaning as commonly understood by those skilled in the art. The terms as used herein in the description of the present disclosure are for the purpose of describing particular embodiments only, and are not intended to be limitations of the present disclosure.

Figure 1:
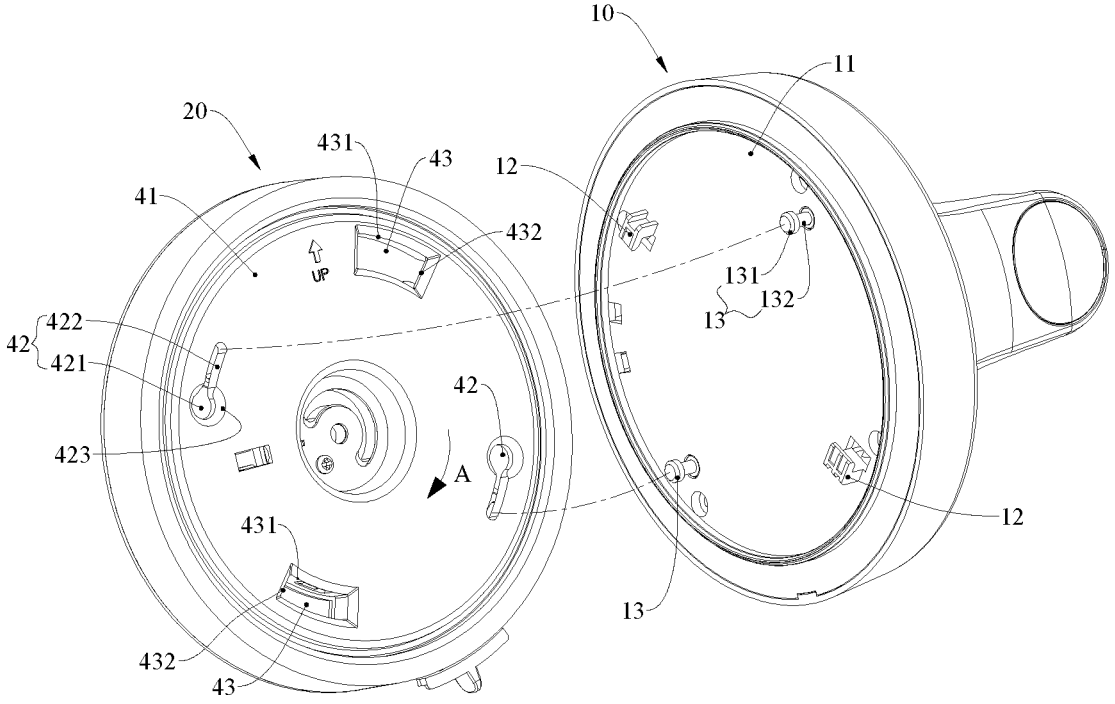
FIG. 1 is an exploded diagram illustrating a base and a module of a quick-install structure for an electrical device according to an embodiment.

Referring to FIG. 1, a quick-install structure for an electrical device according to an embodiment includes a base 20 and a module 10. The module 10 may be detachably installed on the base 20. The module 10 may be a part of a product to be installed, such as a part of a smart security luminaire. The base 20 may be installed directly on a wall via expansion screws, or if in some countries/regions, a standard installing junction box is provided, the base 20 may be installed directly on the junction box. The base 20 usually does not need to be detached after installed, and the product with the module 10 may be directly installed on the base 20 or detached from the base 20. Therefore, the base 20 may be manufactured as a standard part, to facilitate the user to update the product or replace the product directly with different types of products.

The module 10 may be rotatable relative to a center of the base 20 to implement the installation and detachment of the module 10. When the module 10 and the base 20 are being assembled, a rear surface 11 of the module 10 and a front surface 41 of the base 20 are fitted with each other. The front surface 41 of the base 20 is provided with two through holes 42 and two gripping slots 43. The rear surface 11 of the module 10 is provided with two metal conductive posts 13 and two gripping hooks 12. The two conductive posts 13 and the two gripping hooks 12 are spaced apart, and uniformly disposed on the same circle having a center disposed on the center of the module 10.

The gripping hooks 12 are in one-to-one correspondence with the gripping slots 43. When the gripping hooks 12 are inserted in the gripping slots 43, the module has a first position and a second position relative to the base. When in the first position, the gripping hooks 12 grip with the gripping slots 43 tightly. When in the second position, the gripping hooks 12 are detached from the tight gripping with the gripping slots 43. The module 10 is switchable between the first position and the second position.

The conductive posts 13 are in one-to-one correspondence with the through holes 42, and the conductive posts 13 are inserted into the corresponding through holes 42. Specifically, the conductive post 13 includes an outer end 131 and a post body 132. The outer end 131 has a diameter larger than the diameter of the post body 132. The through hole 42 includes an inlet 421 and a tail section 422. The inlet 421 has a diameter not smaller than the diameter of the outer end 131, while the tail section 422 has a width not smaller than the diameter of the post body 132 and smaller than the diameter of the outer end 131. Thereby, while the module 10 is switched from the second position to the first position, the post body 132 is slid from the interior of the inlet 421 to the interior of the tail section 422. While the module 10 is switched from the first position to the second position, the post body 132 is slid from the interior of the tail section 422 to the interior of the inlet 421.

Figure 2:
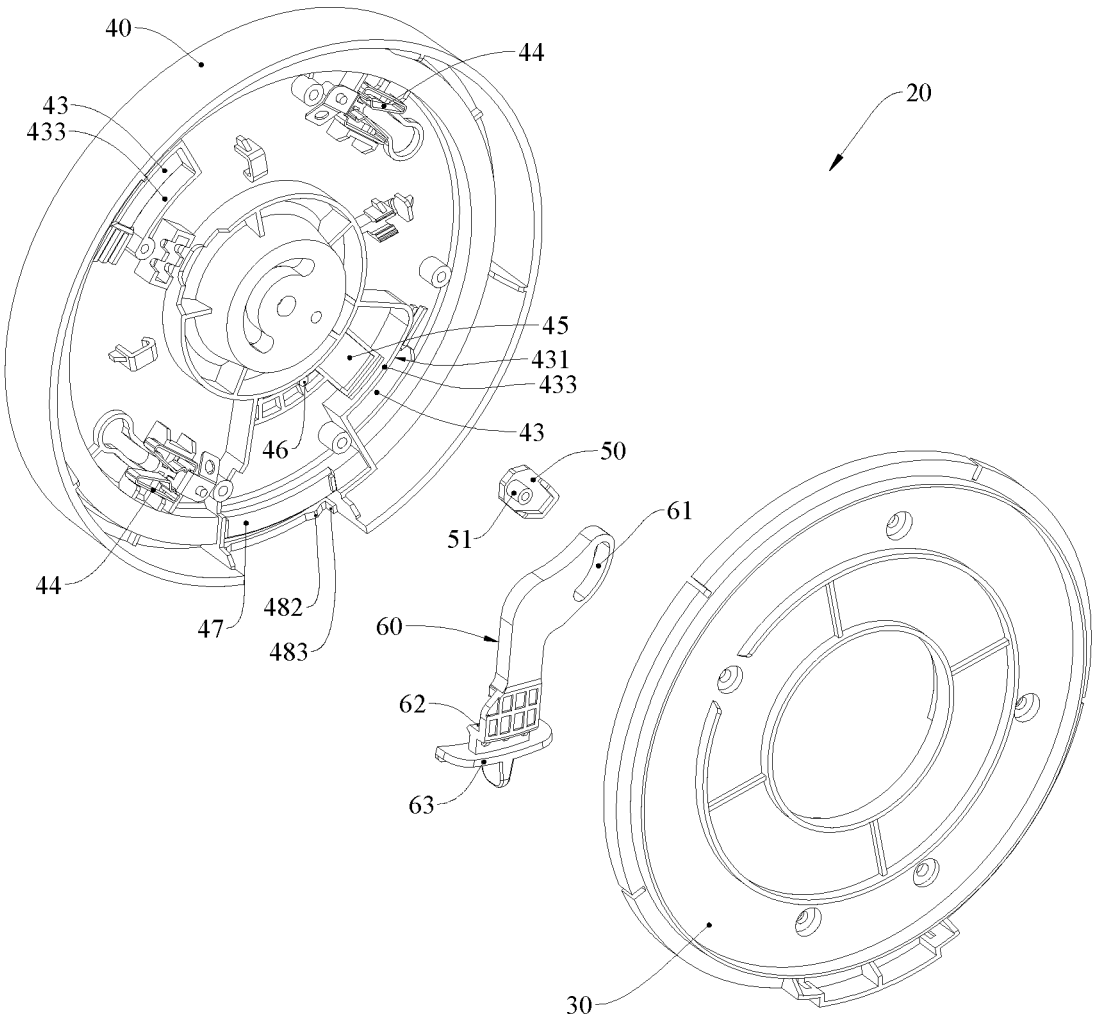
FIG. 2 is an exploded diagram illustrating the base of the quick-install structure for an electrical device of FIG. 1.

A conductive elastic clip 44 is provided at a rear side of each through hole 42 (as shown in FIG. 2). The conductive elastic clip 44 is manufactured as symmetric. The conductive post 13 may be clipped at an intermediate position of the conductive elastic clip 44, and capable of maintaining constant contact to avoid power failure. When two conductive posts 13 are respectively inserted into the inlets 421, and the module 10 is then rotated clockwise (in a direction A), such that the post bodies 132 are slid to the tail sections 422, while the outer ends 131 are in turn clipped by the conductive elastic clips 44 to form contacts, thereby achieving electrical conduction. In addition, an edge of the inlet 421 is provided with a chamfer 423, such that the conductive post 13 is more convenient to find the inlet 421 when being inserted.

The gripping slot 43 on the front surface of the base is in a rectangle shape. The gripping slot 43 includes a long side 431 and a short side 432, wherein the long side 431 is shaped in a circular arc, and the circle center of the long side 431 is the center of the base 20. The gripping slot 43 includes an opening edge provided with a chamfer. The gripping hook 12 protrudes from the rear surface 11 of the module 10 and itself is in a right-angle shape. While the conductive posts 13 are inserted into the inlets 421, the gripping hooks 12 are also inserted into the gripping slots 43 at the same time. The gripping hooks 12 grip with the gripping slot 43 not tightly. At this moment, the module 10 is in the second position relative to the base 20. The module 10 is then rotated clockwise (in the direction A), such that the gripping hooks 12 may be moved clockwise within the gripping slots 43 with the rotation, until the gripping hooks 12 are fastened to the short side 432. At this moment, the module 10 is in the first position relative to the base 20. Referring to FIG. 2, at the rear side of the gripping slot 43 is provided with a three-sided surrounding plate 433, and at the rear side of the short side 432 fastened by the gripping hook 12 is provided with no surrounding plate. If the module 10 is rotated counterclockwise (in the opposite direction of the direction A), the module 10 may be switched from the first position to the second position.

In other embodiments, the module may be installed on the base or detached from the base by means of translation, and the number of the gripping hooks may be more than two, but it requires for ensuring uniform distribution and force balance.

Referring to FIG. 2, the base 20 includes a front cap 40 and a rear cap 30. The front cap 40 and the rear cap 30 are fixedly connected by screws. The base 20 are provided with a tab 50 and a swinging bar 60 therein. It can be understood that the tab 50 and the swinging bar 60 are installed so as to be interposed between the front cap 40 and the rear cap 30. The tab 50 may be protruded or retracted through a side wall of the gripping slot 43 by sliding. The swinging bars 60 are connected to the tabs 50 correspondingly. The swinging bar 60 is slidable relative to the base, and is configured to control the protrusion and the retraction of the tab 50. An inner groove 45 in straight type for limiting the sliding track of the tab 50 is provided in the front cap 40. The inner groove 45 is adjacent to the surrounding plate 433 corresponding to the mar side of one long side 431 of the gripping slot 43, and the inner groove 45 is communicated with the gripping slot 43. The tab 50 is disposed in the inner groove 45, and the tab 50 is slidable within the inner groove 45 and may pass through the surrounding plate 433 into the interior of the gripping slot 43. When the module 10 is in the first position relative to the base 20, the tab 50 protrudes from the side wall of the gripping slot 43, and blocks the gripping hook 12 (as shown in FIG. 1), such that the gripping hook 12 may not be detached from the short side 432, thereby preventing the module 10 to switch from the first position to the second position, that is, locking the module 10. The module 10 will not automatically be rotated by vibration to detach from the base 20, which further improves the reliability of the fastening of installation of the module 10.

Referring to FIGS. 1 and 2 together, the swinging bar 60 includes a toggle portion 63, and the toggle portion 63 at an outer side of the swinging bar 60 is exposed outside the base 20. The swinging bar 60 is rotatably slidable relative to the base 20. Specifically, the front cap 40 is provided with a guide rail 47 shaped in a circular arc. A circle center of the guide rail 47 is a center of the front cap 40, and the swinging bar 60 is provided with a groove 62 thereon. A cross-section of the groove 62 is U-shaped. The groove 62 is engaged with the guide rail 47 to form a sliding connection. While the user is pushing the toggle portion 63 of the swinging bar 60, the swinging bar 60 may rotate along the track of the guide rail 47 around the center of the front cap 40. When implementing, a small amount of grease may be coated on a contact surface of the groove 62 on the swinging bar 60 with the guide rail 47 to reduce frictional resistance and wear. In addition, the front cap 40 of the base 20 is provided with a positioning post 46. On a surface of the swinging bar 60 facing towards the positioning post 46 is provided a cavity 64. The positioning post 46 is disposed in the cavity 64, and is maintained to contact a side wall 641 of the cavity 64. A distance from the positioning post 46 to the center of the front cap 40 is smaller than a distance from the guide rail 47 to the center of the front cap 40. The positioning post 46 and the guide rail 47 effectively position the swinging bar 60 respectively from the inside and the outside, thereby avoiding misplacement and also making the swinging bar 60 more stable when sliding.

The swinging bar 60 is provided with a sliding slot 61, and the tab 50 is provided with a cylinder 51 inserted into the sliding slot 61. When the swinging bar 60 is toggled by the user to slide, the sliding slot 61 pushes the tab 50 to protrude or retract by pushing the cylinder 51. The sliding slot 61 in this embodiment is shaped in a circular arc. A convex direction of the sliding slot 61 faces outward, which may make the protrusion or retraction process of the tab 50 relatively linear in cooperation with an arc-shaped sliding track of the swinging bar 60.

Figures 1, 4:
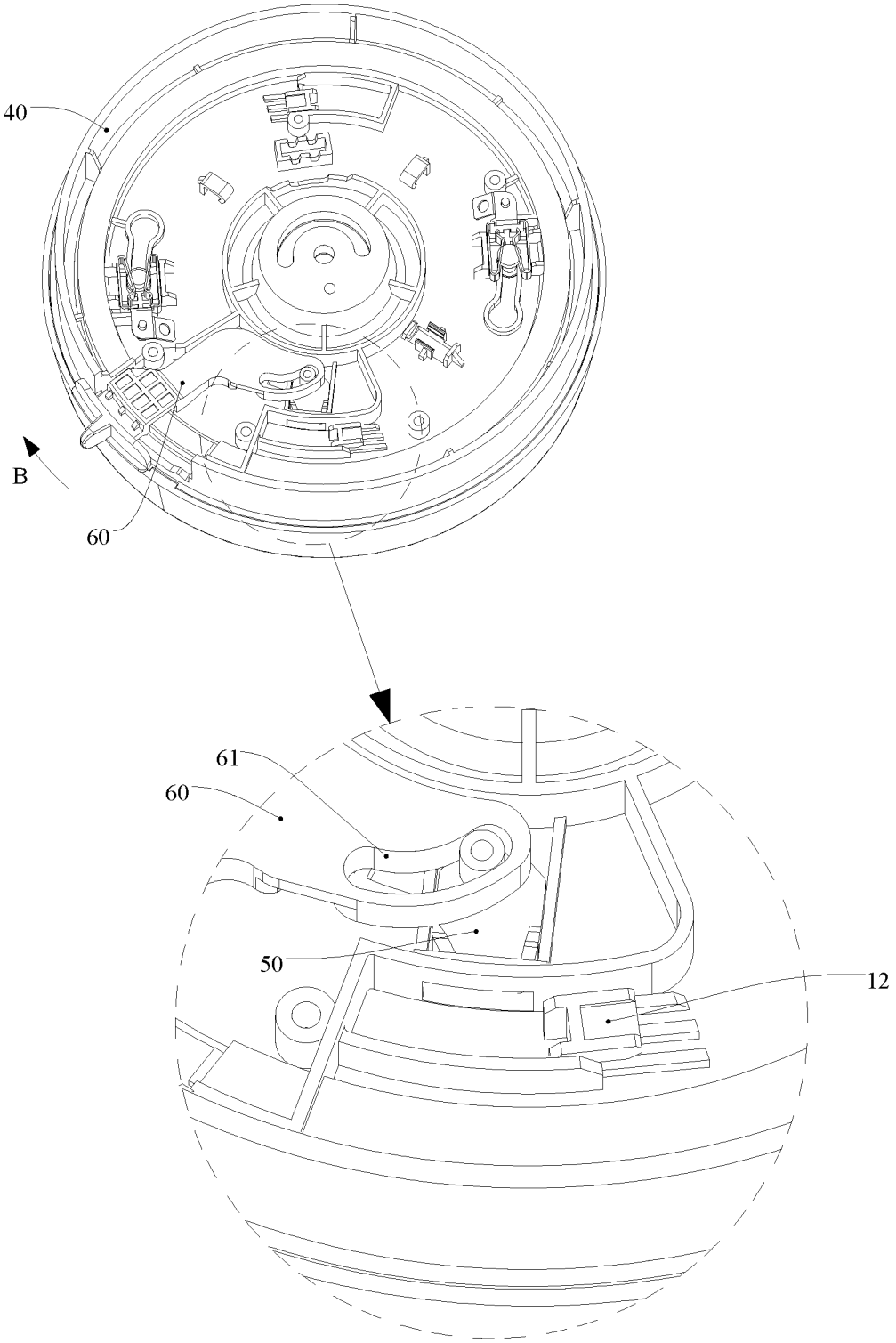
Figures 2, 4:
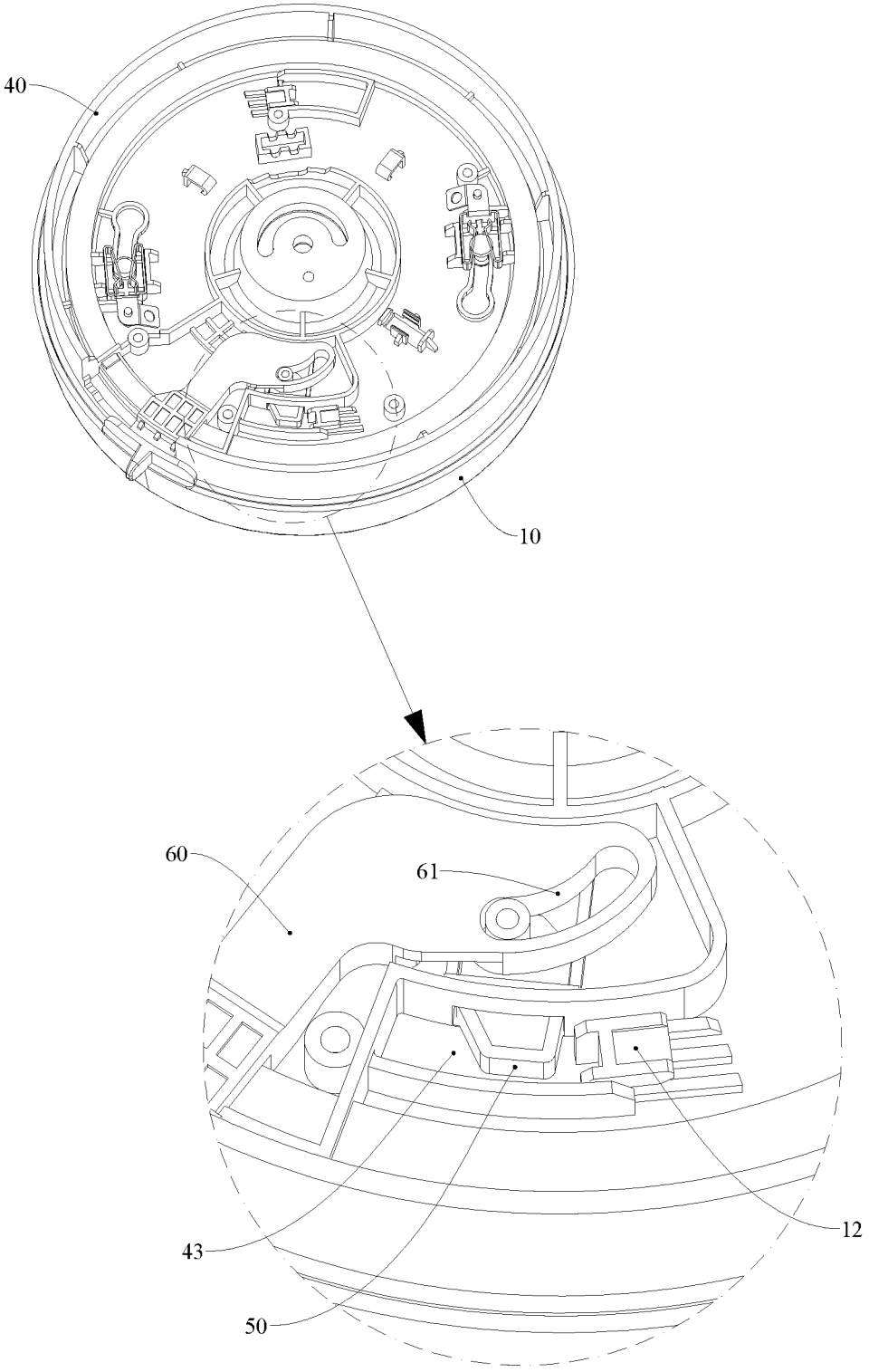

Referring to FIG. 4-1, in this embodiment, the clockwise (in a direction B) slide of the swinging bar 60 will retract the tab 50, and the counterclockwise (in an opposite direction to the direction B) slide of the swinging bar 60 will protrude the tab 50. When the swinging bar 60 is in an opening position, the sliding slot 61 forces the tab 50 to move to a position closest to the center of the front cap 40, that is, the tab 50 is in a fully retracted position. At this moment, the gripping hook 12 is not blocked, and the module 10 is in the first position and may be rotated following the direction B to detach. By toggling the swinging bar 60 along the opposite direction of the direction B, the sliding slot 61 may force the tab 50 to pass into the gripping slot 43 to obtain the state illustrated in FIG. 4-2. In FIG. 4-2, the gripping hook 12 will be blocked by the tab 50, and is not able to detach from the gripping slot 43, whereby the module 10 is not able to be detached.

However, in other embodiments, the sliding slot in this embodiment may also be horizontally symmetrical, and then the swinging bar protrudes the tab by sliding clockwise, and retracts the tab by sliding counterclockwise.

In other embodiments, a number of the tabs may be set to more than 1. The swinging bars are in one-to-one correspondence with the tabs, and all the swinging bars may be provided with synchronous linkage (for example, implementing the linkage through a connecting rod). As long as one of the swinging bars is toggled, the other swinging bars will push the tabs by following the movement, and then achieving a synchronized locking. Although a plurality of tabs increases the complexity of the structure, the reliability of the locking effect is improved.

In other embodiments, if the base is manufactured in a polygon shape instead of a round shape, the swinging bar may also be slid in a straight line, while the sliding slot of the swinging bar may also be manufactured in a straight line.

In addition, referring to FIG. 3 again, the side wall of the front cap 40 is provided with a notch 48, and the toggle portion 63 is exposed outside the notch 48. The notch 48 includes an inner wall surface 481 provided with projections 482 and 484, and vertical walls 483 and 485. The projection 482 and the vertical wall 483 are referred to FIG. 2. The two vertical walls 483, 485 are respectively disposed at two ends of the inner wall surface 481, and the two projections 482, 484 are disposed between the two vertical walls 483, 485. The swinging bar 60 further includes a surface 65 facing towards the inner wall surface 481. The surface 65 is provided with three ribs 66, 67, 68, wherein the two ribs 66, 68 are flush with two side edges of the surface 65. The side surfaces of the two projections 482, 484 are all inclined surfaces to avoid the rib 66 from not being capable of passing over the projection 482 or avoid the rib 68 from not being capable of passing over the projection 484. The minimum distance between the projection 482 and the vertical wall 483 is equal to a thickness of the rib 66. The minimum distance between the projection 484 and the vertical wall 485 is equal to a thickness of the rib 68.

Figure 3:
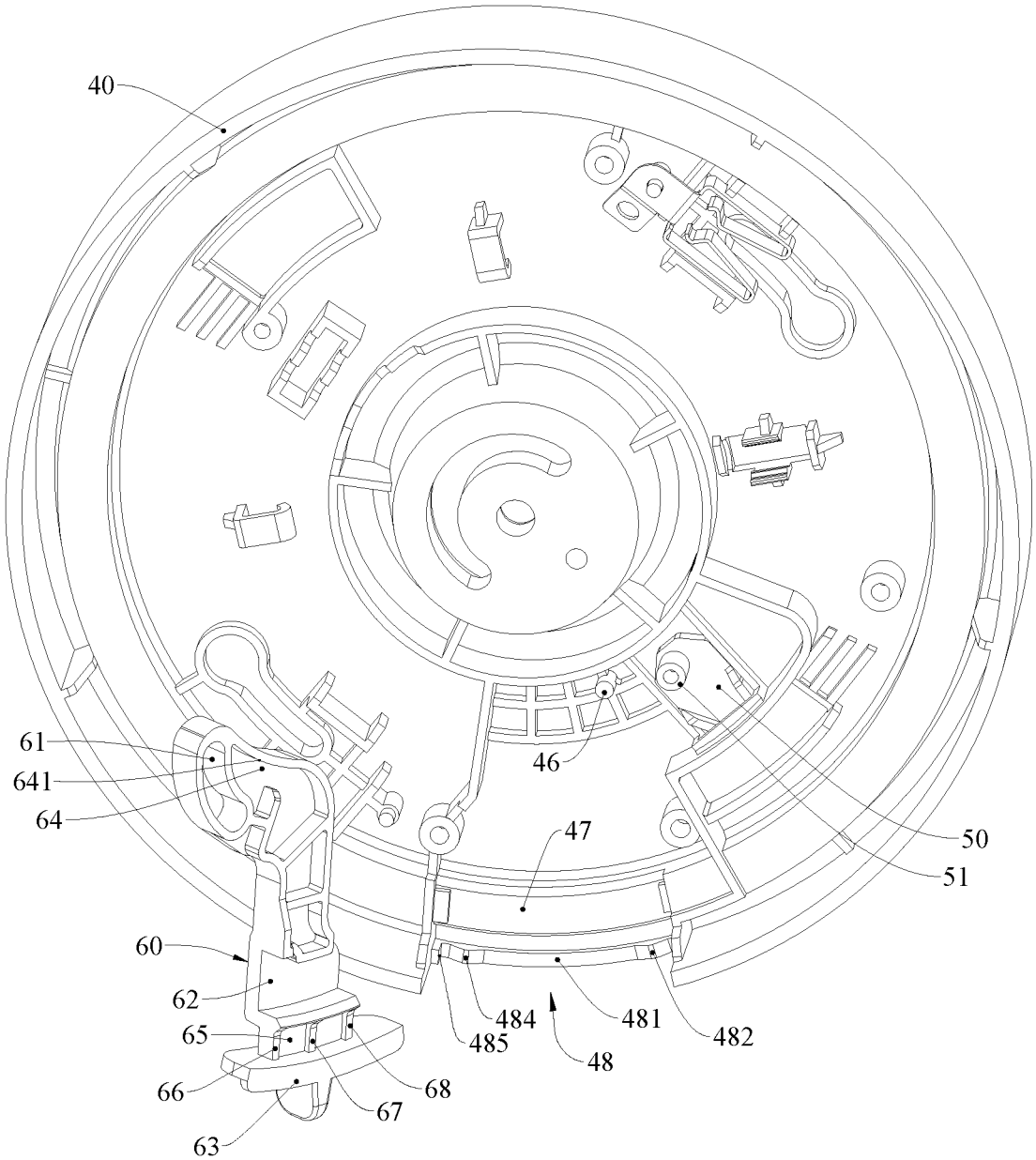
FIG. 3 is an exploded diagram illustrating a front cap and a swinging bar of the quick-install structure for an electrical device of FIG. 2.

Referring to FIG. 3 and FIG. 4-1 together, when the swinging bar 60 is slid to a position where the tab 50 is completely retracted, the rib 68 is located between the projection 484 and the vertical wall 485. Therefore, at this moment the projection 484 acts as a barrier against the rib 68, such that the rib 68 will not pass over the projection 484 automatically, and the swinging bar 60 will not be slid freely.

Referring to FIG. 3 and FIG. 4-2, when the swinging bar 60 is slid to a position where the tab 50 is completely protruded, the rib 66 is located between the projection 482 and the vertical wall 483. Therefore, at this moment the projection 482 acts as a barrier against the rip 66, such that the rip 66 of the swinging bar 60 will not pass over the projection 482 automatically, and the swinging bar 60 will not be slid freely. The tab 500 will then not be retracted automatically, and the gripping hook 12 will be blocked by the tab 50 constantly.

The quick-install structure which implements the fastening of quick installation and quick detachment via the cooperation of the gripping hooks 12 and the gripping slots 43, has a simple structure and low costs. On the basis of the original connection structure with metal conductive posts, the quick-install structure is suitable to be used as an auxiliary fastening connection structure, and capable of enhancing the reliability of the fastening of installation of the module 10 on the base 20. The quick-install structure of the disclosure is suitable for smart security luminaires, smart cameras, wall lamps, wall fans, and the like.

All of the technical features in the embodiments can be employed in arbitrary combinations. For purpose of simplifying the description, not all arbitrary combinations of the technical features in the embodiments illustrated above are described. However, as long as such combinations of the technical features are not contradictory, they should be considered as within the scope of the disclosure in the specification.

The above embodiments are merely illustrative of several implementations of the disclosure, and the description thereof is more specific and detailed, but should not be deemed as limitations to the scope of the present disclosure. It should be noted that variations and improvements will become apparent to those skilled in the art to which the present disclosure pertains without departing from its scope. Therefore, the scope of the present disclosure is defined by the appended claims.

What is claimed is:

1. A quick-install structure for an electrical device comprises:

a base provided with at least two gripping slots; and a module detachably installed on the base, the module being provided with at least two gripping hooks, and the gripping hooks being in one-to-one correspondence with the gripping slots; wherein when the gripping hooks are inserted in the gripping slots, the module has a first position and a second position relative to the base, and wherein when in the first position, the gripping hooks grip with the gripping slots tightly; when in the second position, the gripping hooks are detached from the tight gripping with the gripping slots; the module is switchable between the first position and the second position;

wherein the base is provided with a tab therein, the tab is protrudable or retractable through a side wall of the gripping slot, when the module is in the first position and the tab protrudes from the side wall of the tab, the gripping hook is blocked by the tab, and the gripping hook prevents the module from switching from the first position to the second position.

2. The quick-install structure for an electrical device of claim 1, wherein the base is provided with a swinging bar configured to control the protrusion and the retraction of the tab, the swinging bar is slidable relative to the base and corresponds to the tab.

3. The quick-install structure for an electrical device of claim 2, wherein the swinging bar is provided with a sliding slot, the tab is provided with a cylinder, the cylinder is inserted into the sliding slot, and the swinging bar controls the protrusion and the retraction of the tab via linkage of the sliding slot and the cylinder.

4. The quick-install structure for an electrical device of claim 3, wherein the sliding slot of the swinging bar is shaped in a circular arc or in a straight line.

5. The quick-install structure for an electrical device of claim 2, wherein the base is provided with a guide rail shaped in a circular arc, a circle center of the guide rail is a center of the base, the swinging bar is provided with a groove, the groove is engaged with the guide rail to form a sliding connection, and the swinging bar rotates along a track of the guide rail around the center of the base.

6. The quick-install structure for an electrical device of claim 5, wherein a cross section of the groove is U-shaped.

7. The quick-install structure for an electrical device of claim 5, wherein the base is provided with a positioning post, at a side of the swinging bar facing towards the positioning post is provided a cavity, and the positioning post is disposed in the cavity and is maintained to contact a side wall of the cavity; a distance from the positioning post to the center of the base is smaller than a distance from the guide rail to the center of the base.

8. The quick-install structure for an electrical device of claim 3, wherein the base is provided with a guide rail shaped in a circular arc, a circle center of the guide rail is a center of the base, the swinging bar is provided with a groove, the groove is engaged with the guide rail to form a sliding connection, and the swinging bar rotates along a track of the guide rail around the center of the base.

9. The quick-install structure for an electrical device of claim 8, wherein a cross section of the groove is U-shaped.

10. The quick-install structure for an electrical device of claim 8, wherein the base is provided with a positioning post, at a side of the swinging bar facing towards the positioning post is provided a cavity, and the positioning post is disposed in the cavity and is maintained to contact a side wall of the cavity; a distance from the positioning post to the center of the base is smaller than a distance from the guide rail to the center of the base.

11. The quick-install structure for an electrical device of claim 2, wherein a side wall of the base is provided with a notch, the swinging bar comprises a toggle portion, and the toggle portion of the swinging bar is exposed outside the notch; the notch comprises an inner wall surface provided with a projection and a vertical wall, the swinging bar further comprises a surface facing towards the inner wall surface, the surface is provided with a rib, when the swinging bar slides to a position where the tab is completely protruded, the rib is located between the projection and the vertical wall.

12. The quick-install structure for an electrical device of claim 3, wherein a side wall of the base is provided with a notch, the swinging bar comprises a toggle portion, and the toggle portion of the swinging bar is exposed outside the notch; the notch comprises an inner wall surface provided with a projection and a vertical wall, the swinging bar further comprises a surface facing towards the inner wall surface, the surface is provided with a rib, when the swinging bar slides to a position where the tab is completely protruded, the rib is located between the projection and the vertical wall.

13. The quick-install structure for an electrical device of claim 2, wherein the base comprises a front cap and a rear cap, and the tab and the swinging bar are installed so as to be interposed between the front cap and the rear cap.

14. The quick-install structure for an electrical device of claim 3, wherein in the base is provided an inner groove configured to limit a sliding track of the tab, the inner groove is communicated with the gripping slot, and the tab is disposed in the inner groove and is slidable in the inner groove.

15. The quick-install structure for an electrical device of claim 1, wherein when the module is switched between the first position and the second position, the module is rotated relative to a center of the base.

16. The quick-install structure for an electrical device of claim 15, wherein a rear surface of the module and a front surface of the base are fitted with each other, the gripping hooks are provided on the rear surface of the module, and the gripping slots are provided on the front surface of the base.

17. The quick-install structure for an electrical device of claim 1, wherein the base is provided with two through holes, the module is provided with two metal conductive posts, the conductive posts are in one-to-one correspondence with the through holes, and the conductive posts are inserted into the corresponding through holes.

18. The quick-install structure for an electrical device of claim 17, wherein the conductive post comprises an outer end and a post body, and the outer end has a diameter greater than a diameter of the post body; the through hole comprises an inlet and a tail section communicated with each other, the inlet has a diameter not smaller than the diameter of the outer end, the tail section has a width not smaller than the diameter of the post body, and the width of the tail section is smaller than the diameter of the outer end; while the module is switched from the second position to the first position, the post body slides from an interior of the inlet to an interior of the tail section; while the module is switched from the first position to the second position, the post body slides from the interior of the tail section to the interior of the inlet.

19. The quick-install structure for an electrical device of claim 17, wherein the through hole is provided with a conductive elastic clip, and the conductive post contacts the conductive elastic clip.

* * * * *